US010438421B2

(12) United States Patent
Bashani

(10) Patent No.: US 10,438,421 B2
(45) Date of Patent: Oct. 8, 2019

(54) PARKING STATUS SYSTEM

(71) Applicant: Gilad G. Bashani, Clayton, MO (US)

(72) Inventor: Gilad G. Bashani, Clayton, MO (US)

( * ) Notice: Subject to any disclaimer, the term of this patent is extended or adjusted under 35 U.S.C. 154(b) by 1069 days.

(21) Appl. No.: 14/562,149

(22) Filed: Dec. 5, 2014

(65) Prior Publication Data

US 2016/0163119 A1 Jun. 9, 2016
US 2018/0276901 A9 Sep. 27, 2018

Related U.S. Application Data

(63) Continuation-in-part of application No. 13/245,385, filed on Sep. 26, 2011, now abandoned.

(60) Provisional application No. 61/386,645, filed on Sep. 27, 2010.

(51) Int. Cl.
*G07B 15/02* (2011.01)
*G07B 15/00* (2011.01)

(52) U.S. Cl.
CPC ..... *G07B 15/00* (2013.01)

(58) Field of Classification Search
CPC ..... G07B 15/00; G07B 15/02
USPC ..... 705/13
See application file for complete search history.

(56) References Cited

U.S. PATENT DOCUMENTS 6,340,935 B1 1/2002 Hall
RE38,626 E 10/2004 Kielland
2002/0109610 A1* 8/2002 Katz ..... G07B 15/02 340/932.2
2003/0128630 A1* 7/2003 Krygler ..... G07F 17/248 368/90
2004/0068433 A1 4/2004 Chatterjee
2004/0133464 A1 7/2004 Erskine
2004/0181496 A1 9/2004 Odinotski
2006/0059037 A1 3/2006 Ivey
(Continued)

FOREIGN PATENT DOCUMENTS

WO WO-02063243 A1 * 8/2002 ..... G01C 21/20
WO WO2002063243 8/2002
(Continued)

OTHER PUBLICATIONS

V100 GPS compass in parking enforcement. (Apr. 2010). Bev-AL Communications, Inc., vol. 9, Issue 4, p. 6. (Year: 2010).*

*Primary Examiner* — Kevin H Flynn
*Assistant Examiner* — Hunter A Molnar
(74) *Attorney, Agent, or Firm* — Charles C. McCloskey

(57) ABSTRACT

A parking status system overlays upon images of a street, a lot, or a garage with representations of parked vehicles the status of any parking space shown in the image. A user retrieves the merged image with the vehicles parking in select spaces through a wireless communications network from the parking management computer system. The user then verifies payment status of multiple parking spaces simultaneously as the user patrols a beat on foot or in a vehicle. The present invention operates upon existing web browsers. The present invention allows a user to select any view within 360 degrees of the user's position in different sizes and while in motion. The present invention refreshes the status of parking spaces and subscriber vehicles at a regular interval. The invention transforms parking space, payment, and subscriber data into parking space status shown in real time to a user.

7 Claims, 4 Drawing Sheets

(56) References Cited

U.S. PATENT DOCUMENTS

| | | | | |
|---|---|---|---|---|
| 2007/0267479 | A1* | 11/2007 | Nix | G06Q 20/10 235/379 |
| 2008/0055050 | A1 | 3/2008 | Brown | |
| 2011/0099126 | A1* | 4/2011 | Belani | G06Q 30/0284 705/418 |
| 2012/0078686 | A1* | 3/2012 | Bashani | G07B 15/00 705/13 |
| 2014/0214500 | A1* | 7/2014 | Hudson | G06Q 30/0284 705/13 |
| 2014/0372185 | A1* | 12/2014 | Ganot | G07B 15/02 705/13 |

FOREIGN PATENT DOCUMENTS

| | | | | |
|---|---|---|---|---|
| WO | WO2005086097 | | 9/2005 | |
| WO | WO-2005086097 | A1 * | 9/2005 | G06Q 20/127 |

* cited by examiner

PARKING STATUS SYSTEM

CROSS-REFERENCE TO RELATED APPLICATION

This continuation in part application claims priority to the pending non-provisional application Ser. No. 13/245,385 filed on Sep. 26, 2011 which claims priority to the expired provisional application 61/386,645 filed on Sep. 27, 2010 which is owned by the same inventor.

BACKGROUND OF THE INVENTION

The parking status system generally relates to electronic display of parking status and more specifically to overlay of parking status of vehicles upon a visual image of a street. The present invention provides an efficient visual representation of parking status and an intuitive interface where a parking control officer verifies the parking status of a vehicle seen by the officer and the payment status of the vehicle whether by existing meter, pay and display unit, or remote payment system.

When people travelled by horse, the rider tied reigns of the horse to a hitching rail when the rider dismounted in town. Remembering the needs of the horse, the rider returned to the horse in a timely manner and the hitching rail opened for another rider to tie up his horse. Then people began using automobiles.

People drive their automobiles, or cars, to many destinations. Some destinations became popular for automobiles and necessary for people. People take their cars to stores, movie theatres, parks, government offices, sporting events, businesses, and the like. Early on, few people had cars. However, cars have become present in great numbers, so much so that planners account for cars in road design and urban planning. People though do not drive their cars indefinitely. Cars eventually bring their drivers and passengers to a destination. At a destination, people park their cars.

At some destinations, parking remains plentiful in lots, such as at stores, malls, and sporting events. In urban areas, the concentration of businesses draws people and their cars. However, the streets adjacent to buildings accommodate only a finite number of cars. As a compromise between parking near a building and the space available, parking spaces became metered, that is, rented. Because streets are generally owned by municipalities, city governments usually operate parking meters and deploy the legions of parking control officers that enforce the parking regulations.

Parking meters have generally accepted coins in various denominations in exchange for a certain amount of time to park a car adjacent to a meter. The rate per hour for a parking space varies among municipalities. Generally, a driver finds an empty parking space for his or her vehicle near the driver's destination. The driver then deposits coins in the adjacent meter for the desired amount of time. The driver then walks away from the vehicle. Meanwhile, a parking control officer, on foot or mounted in a vehicle, checks the meter from time to time. Meters often indicate when the time has expired with visual signals displayed upon the meter. If a parking control officer sees such a signal, the officer can then issue a ticket to the holdover driver. Parking control officers walk or drive an assigned beat, or block of addresses, noting expired meters.

DESCRIPTION OF THE PRIOR ART

Along streets and in some garages for many years, parking meters have accepted coins as payment. Select garages and surface lots have central payment boxes or guardhouse. These parking venues often have a "Pay & Display" kiosk located at a suitable position such as at a pedestrian entrance, an elevator, or at each city block. In Pay & Display, a motorist buys a ticket at a kiosk using currency or credit and the kiosk prints a paper ticket with an expiration time thereon. The motorist then places the ticket upon the dashboard of his car so a parking control officer can view the ticket. In select garages, as at airports, motorists receive a ticket upon entry to the garage but may pay for their parking at a kiosk away from the entrance. The kiosk may be located near where motorists return from a passenger air terminal near the garage. The kiosks accept currency and credit and allow a certain time for the motorist to depart the garage in his vehicle.

However, the majority of parking meters still rely upon coins. Though coins remain present and legal tender, coins occasionally inconvenience motorists who find themselves without coins at a meter. Then the motorist must find coins often by changing paper currency into coins at a nearby retail establishment. Some retailers accept this activity while others frown upon it. Recently, as commerce has gone to more electronic payments, coin operated meters appear antiquated. Coin meters have their dedicated parking control officers that enforce the parking ordinances against those motorists who have parked too long in a metered space. Coin meters still require maintenance workers that empty the coin boxes daily and repair damaged meters occasionally.

Various efforts have occurred to bring cashless payment to parking meters and some garages. One cashless payment method includes using a mobile telephone to pay for parking in a surface lot. A mobile phone payment system, such as the system provided by Verrus, Inc. of Vancouver, British Columbia, Canada, allows a user to click or otherwise indicate assent to a charge right upon the phone, have the charge adjust the parking status as paid until a certain time, and have the charge then appear on the monthly phone bill.

Payments by mobile phone generally involve a server computer system that receives messages from motorists' mobile phones and transmits commands to select parking meters. These messages generally inform the server that payment for parking by the motorist's mobile phone has begun or has terminated. The parking meters then emit their status upon command.

Enforcement in such a system utilizes remote querying of the parking meters by the server computer system to verifying the payment status of an individual parking meter and an adjacent vehicle. The typical query has a parking control officer contact the server computer system and manually enter an identifier of the vehicle, such as a license plate number—or an alphanumeric string. The manual entry of vehicle identifiers of every parked vehicle on an officer's beat renders such a payment system practically unusable. This prior art system lacks a satisfactory mechanism so parking control officers can easily and efficiently retrieve information regarding real time parking payment status of a vehicle in a certain space from such a server computer system.

Another prior art parking system utilizes smart card loaded funds to pay a parking meter with a digital reader. A smart card generally has a small microprocessor or chip located upon it. The chip can store funds loaded from an approved banking or financing source, such as an ATM. The chip integrates with the remainder of the smart card where the smart card has a size similar to that of a credit card or debit card. This prior art system shows loading of funds into a third party device, such as a chip, that a parking meter or other device can recognize as payment.

The patent publication to Ivey & Janacek, No. 2006/0059037 explains local enforcement of remotely managed parking payment systems. Ivey shows a system that places the status of parking spaces upon a map. The map shows a street and nearby vehicles in two dimensions, generally from above. The map does not display images of the actual vehicles but rather a stylized image of the vehicles.

The publication to Erskine, No. 2004/0133464, describes a parking system with payment terminals, enforcement terminals, occupancy data transmitted between the terminals, and a two way telecommunications network. Erskine also has a display with graphic images of parking spaces, para. [0030]. Erskine also describes graphic information about the parking space, including landmarks, [0009]. Erskine does not mention video or digital pictures of a parking space.

The publication to Chatterjee, No. 2004/0068433 illustrates a parking system with maps of parking spaces that allows subscribers to pay for parking by wireless or web communications. Chatterjee also uses license plate readers to identify specific vehicles. In its description, Chatterjee mentions HTML as a programming language but it omits description of parking status merged with a picture of a parking space and its surroundings.

The U.S. patent to Hall, U.S. Pat. No. 6,340,935, shows GPS technology to automate a parking facility. Hall provides a GPS position of a vehicle upon a map as shown on a mobile unit. Hall also uses GPS data to regulate vehicles within a parking facility.

And, the publication to Odinotski, No. 2004/0181496, describes a anetworked parking system with a database spread upon various parking terminals. The '196 pub. portrays a mapping function and the ability to orient the map or graphical display as a user moves, para. [0057]. The '196 pub. also mentions a graphical user interface 8 but does not describe pictures of a parking space. The '196 pub. does not show linking of payment status, GPS position fixing, and digital or video imagery.

Other technology now affects the parking payment systems. Augmented reality, or AR, serves as an imaging technology where a live direct or indirect view of a physical real-world environment has elements augmented by virtual computer-generated imagery. AR has a relationship to the general concept of mediated reality where an image of reality undergoes modification by a computer, possibly even diminished rather than augmented. As a result, AR enhances a user's real time perception of a real image. In AR, the augmentation generally occurs in real time and in semantic context with environmental elements, such as sports scores on television, scrolling beneath a game. With advanced AR technology, such as computer vision and object recognition, the information about the surrounding real world of the user becomes interactive and digitally usable. Artificial information about the environment and the objects becomes a layer imposed upon a view of the real world. AR technology includes the application of computer generated imagery in live video streams as a way to expand a user's view of the world.

Another parking management system utilizes fixed plates mounted in a parking space and a reading device for an inspector. The fixed plates include a small emitter that transmits upon interrogation by the reading device. Mounted in a parking space, the fixed plates remain subject to degradation by the environment of the space such as debris, snow, street sweeping machinery, snow plows, and the like. In approximately three years, the emitter in the fixed plate loses power and calls for replacement. Replacing the emitter involves removing the plate from the parking space surface using tools and minor excavation thus raising the maintenance costs of the system. Further, the reading device comes with a price tag in excess of $8000 and utilizes key pad entry. The key pad entry has encountered operational difficulty from users wearing gloves, driving a vehicle, or both.

The present invention overcomes the disadvantages of the prior art and provides a parking status system that visually indicates parking meter status of vehicles in the field of view of a parking control officer while stationary or moving. The present invention does not require a parking control officer to key in data and also does not utilize optical character recognition. The present invention utilizes GPS for position fixing of vehicles generally upon streets, less so in garages. The present invention simultaneously displays parking status upon a visual image of vehicles along a street or in a garage to the officer. The present invention also allows member users, or subscribers, to prepay parking and have any parking meter adjacent to a subscriber's car read as PAID.

SUMMARY OF THE INVENTION

Generally, the parking status system has software upon a portable electronic device that integrates position, direction, view ahead, and parking meter status into a common visual image updated in real time. The system utilizes images of street scenes and adjacent buildings to establish a position of the device usually held by a parking control officer. The system then overlays real time images of vehicles in relation to the position. The system near that position then displays a flag above each vehicle in a parking area near the position as shown in the image. The invention may also include parking meters or other devices located in the parking area that emit their status or condition. The flag indicates if a vehicle has or has not paid for parking or if the meter has a maintenance issue. The system also supports a submodule where motorists subscribe and deposit funds for parking. The system then tracks a subscriber and then debits the subscriber's account for the time the subscriber parks a vehicle in a parking area utilizing this invention. The system updates its image and flag in real time as a parking officer patrols an assigned beat. The present invention collects information from a subscriber's portable electronic device and routes it to a parking authority server via the Internet and communication networks. Select parking areas may still include parking meters capable of indicating their condition into the server of the present invention. The system utilizes GPS technology to match the street scene, parking officer position, and vehicle positions upon a visual image.

A parking control officer receives an image of a street scene, such as cars at a curb, or a street view, that simultaneously shows the parking status of multiple parking positions. The street view image downloads from a server computer system onto a client device held by the parking control officer. The present invention identifies and represents individual parked cars and empty parking spaces in relation to the street view, other parking positions and other street objects. The present invention provides a status flag proximate each parking location in a parking area in the vicinity of the parking control officer's device. The status flags then allow a parking control officer to readily match multiple parking positions shown on the street view with the actual parking positions in the parking control officer's beat. The present invention then matches the parked vehicles by color, make, and model to those of member users, or subscribers. The respective statuses of the other parking spaces also appear in the street view image so that vacant spaces also show their payment status. The present invention overlays the parking status of vehicles upon a visual image of a street or lot as it matches the GPS coordinates of the parking control officer, the vehicle, and the street scene. The parking control officer therefore easily and readily views the parking status of multiple parking positions in a general area.

The parking status of a parking space whether occupied or vacant includes a paid state and an unpaid state. For example, the present invention represents PAID positions with green tag or flag and UNPAID positions with a red tag or flag on the screen of the device held by the parking control officer. Upon finding a vehicle in a parking space having a red flag, the parking control officer can then write a ticket manually or have the parking authority server generate a ticket. To trigger generation of a parking ticket by the parking authority server, the parking control officer photographs a license plate of an offending vehicle using his portable electronic device. The officer then uploads the photo to the server along with a text entry of the license plate number of the offending vehicle. The server then cross references the license plate number with the membership list and mails a ticket directly to the member affiliated with the offending vehicle. If the cross reference does not return a member, then the server cross references the license plate number with a license plate database maintained by a state level agency for registering cars, such as a department of motor vehicles. The server then mails a ticket directly to the owner of the offending vehicle as upon the state registry records. In mailing tickets, the server utilizes printed indicia of the parking authority upon the paper tickets mailed the owners of the offending vehicles. In an alternate embodiment, the server also utilizes vehicle identification numbers during its cross reference function. In an alternate embodiment, other display characteristics of the parking spaces appear on the officer's screen from the invention to show different states of the parking spaces, such as broken meter or no parking by police order.

Using the present invention, the parking control officer can immediately identify parking spaces with parked vehicles occupying them where the spaces indicate an unpaid status. By visual observation of any parking meters in the vicinity, the parking control officer verifies the parking positions shown in the overlaid street view as unpaid or those that have paid using cash or other payment, such as tokens, accepted by the parking meter. The present invention cooperates with conventional coin operated parking meters for payment verification. More particularly, conventional coin operated parking meters still control parking for the same parking spaces but allow for motorists to pay for parking using a mobile telephone subject to verification by the manners and methods of the present invention. Over time, the present invention may remove meters from the street scene. As a substitute for meters, the present invention may stimulate installation of "Pay & Go" units, as later described, to accommodate motorists who seek to pay for parking but do not have a cell phone or other portable electronic device.

The street view image of a street and the pictures of the parked vehicles have a format suitable for sending by a web server and displayed by a conventional web browser. For example, the street view may include images provide from sources using hypertext markup language, HTML.

To specify an initial vicinity of interest for an initial street view, the parking control officer enters an identifier of an individual parking space or obtains the current position from a GPS receiver. The parking control officer can request that the street view adjust according to the change of the officer's position, move the view up or down, rotate left or right, or refresh using software display control. As the parking control officer changes direction or moves, the server of the parking authority updates the parking status and street scene utilizing the GPS positions of the parking control officer and nearby vehicles in real time.

There has thus been outlined, rather broadly, the more important features of the invention in order that the detailed description thereof that follows may be better understood and that the present contribution to the art may be better appreciated. The present invention also includes a membership program for motorists, real time and directional updating, and accommodation of existing and smart parking meters. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a parking status system that organizes and displays the status of a parking space in a parking area and adjacent vehicles upon a visual image of a street ahead of a parking control officer.

Another object is to provide such a parking status system that utilizes GPS technology for a precise merge of location and parking space data as an overlay upon a visual image.

Another object is to provide such a parking status system that transforms parking space location coordinates into an UNPAID or alternatively a PAID status.

Another object is to provide such a parking status system that has a low cost of manufacturing so the purchasing municipalities, other government agencies, parking authorities, and organizations can readily buy the parking status system through supply sources, and procurement channels.

Another object is to provide such a parking status system that has a low cost of deployment so that the motorists can readily subscribe to a payment plan of the system.

Another object is to provide such a parking status system that eliminates the need for parking meters.

Another object is to provide such a parking status system that coexists and co-operates with prior art parking meters.

Another object is to provide such a parking status system that eliminates motorists utilizing residual paid time for a parking space paid by a previous motorist who has departed.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
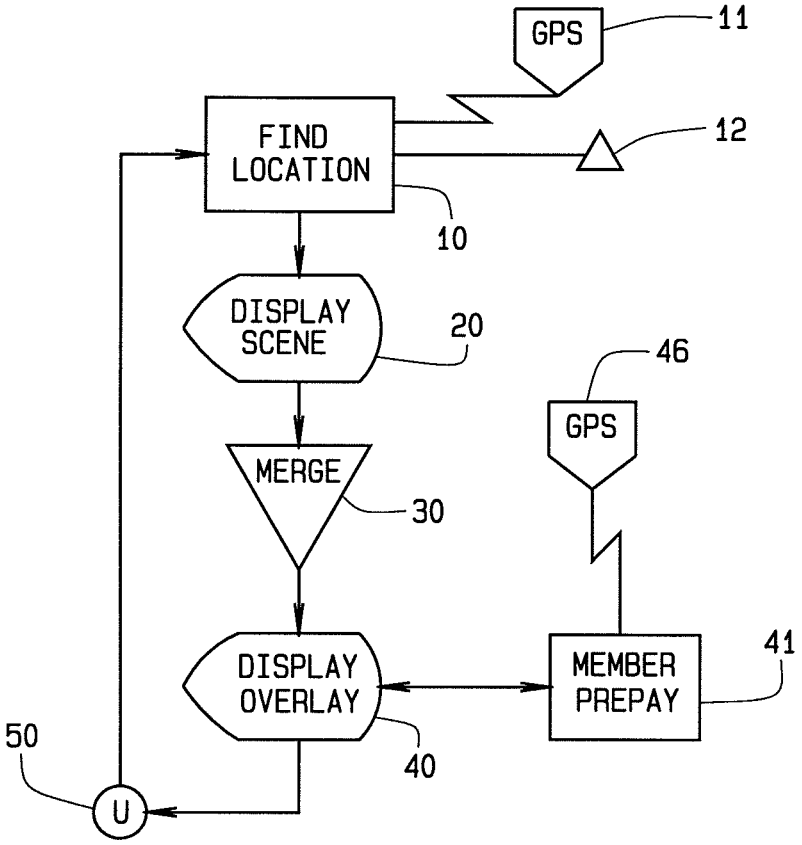
FIG. 1 shows a flow chart of the general operations of the present invention.
Figure 2:
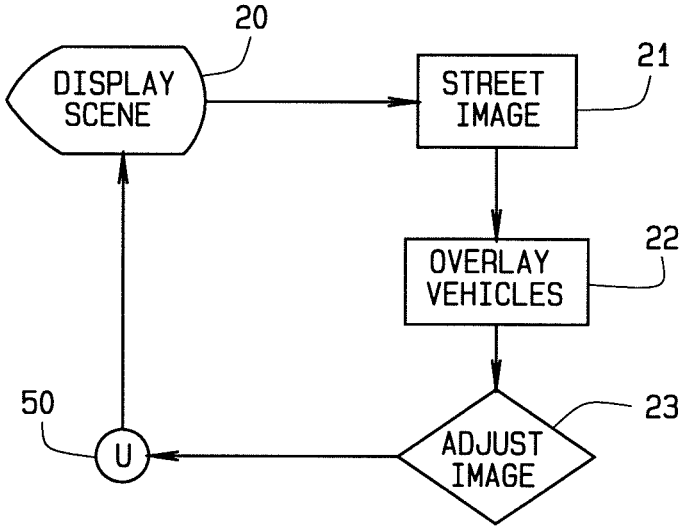
FIG. 2 describes the display scene operation of the invention.
Figure 3:
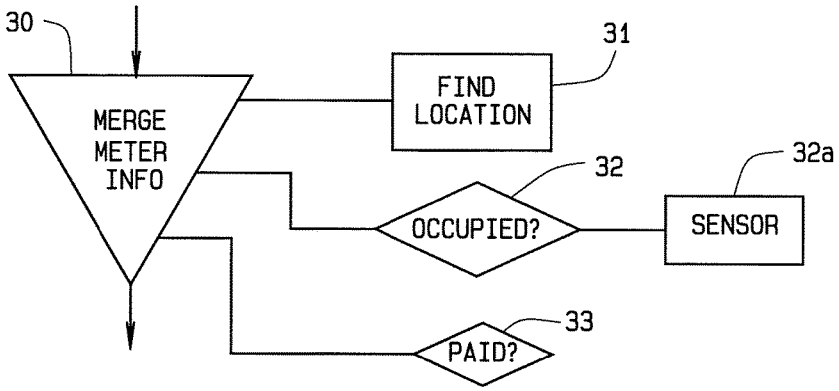
FIG. 3 provides a flow chart of the meter information step of the present invention.

The present invention overcomes the prior art limitations by providing a parking status system upon the portable electronic device p of a parking control officer. The system follows operational steps as shown in FIG. 1, that overcome the limitations of prior devices and methods for providing the status of parking meters and parking spaces to those officers. The present invention begins with determining the parking control officer's position as at 10. The position may come from a GPS fix, as at 11, from the portable electronic device held by the officer or other means of electronic position finding. Determining the position also includes ascertaining the direction of view by the officer as at 12. The direction finding comes from the orientation of the portable electronic device relative to a fixed direction, such as north. In an alternate embodiment, the present invention utilizes the built in compass, gyroscope, or other direction finding capability of the portable electronic device, such as a tablet style computer.

Having determined the position and direction of the portable electronic device and the parking control officer, the present invention finds and displays a live visual image of the scene in the direction of the portable electronic device as at 20. The scene display step utilizes images collected by Google®, tablet computers, digital cameras, and other sources. The scene display step selects the visual images based upon the position and direction of the portable electronic device so that the parking control officer can match the visual images on the portable electronic device and the actual street scene. The scene display step produces the visual images in either two dimensions or three dimensions. Preferably, the present invention utilizes a three dimensional visual image however, the invention may revert to a two dimensional visual image when a three dimensional visual image exceeds the capabilities of the parking officer's portable electronic device. Generally, the present invention utilizes the visual street scene and its parking locations and locates upon the scene visual representations of parked cars and the parking payment status of that parking location or parking space. The present invention meshes the street scene, parking locations, and payment status utilizing GPS positioning as at 46. However, GPS signals may be interrupted or disabled in select locations such as garages and parking beneath overpasses. In these situations without GPS, the present invention utilizes Augmented Reality technology with a parking status overlay. Further, the Augmented Reality utilizes less bandwidth in its communications than when downloading visual street scenes from a third party provider such as Google®.

Augmented Reality includes a real-time view of a user's immediate surroundings altered or enhanced by computer generated information. When users examine their environment through devices using Augmented Reality, they see information superimposed on the objects in a real time view image from around the users. More particularly, augmented reality utilized by the invention provides enhanced version of reality created by overlaying digital information on an image of an object viewed by a user through a portable electronic device, such as a smart phone, tablet computer, laptop computer and the like. The invention applies Augmented Reality as it integrates digital information regarding parking spaces with live video of a user's environment in real time. The present invention takes an existing picture, or image, and overlays new information about parking spaces upon the image. The present invention applies to a live direct or an indirect view of an object or scene an interactive simultaneous engagement of virtual data about parking spaces and their payment and a real image of the parking spaces upon a street.

Next, the present invention builds upon the street scene acquisition with merging of parking space, or parking location, information as at 30, or parking space status. The present invention collects the status of parking spaces from the server, installed sensors, smart meters that emit their status or existing meters that display status through color code or other visual means to the parking control officer. The present invention aligns the parking status with the position of the parking control officer so that the parking control officer sees the parking meter or parking space status overlaid upon the live, or real time, visual image of the street on the portable electronic device.

The present invention then displays select vehicles at select parking spaces in the visual image as at 40. This live, or real time, display of parking status allows a parking control officer to determine if a vehicle in the actual scene viewed by the parking control officer has paid for parking as shown on the visual image. The parking control officer or user U then views the scene before him and acts upon vehicles parked improperly as at 50 then seeks the next vehicles to inspect. The present invention has an alternate embodiment where motorists subscribe to a plan for parking as at 41.

With such a subscription, the subscribing motorist utilizes the caller identification information emitted from his portable electronic device to identify the subscriber for debiting of parking against the subscribed amount. The subscriber's portable electronic device includes a cell phone or a smart phone often with an onboard gyroscope. The present invention supports "Pay & Go" payments where a user subscribes to the present invention on the spot in his time of need even if the user lacks a portable electronic device. A Pay & Go system replaces a gang of parking meters, usually from a street block or two or a defined parking area. The Pay & Go units have locations generally convenient for motorists to approach, such as the middle of a street block or at the entrance to a parking area such as a lot. The Pay & Go units appear similar to prior art Pay & Display systems however, the motorist need not return to his vehicle and place the ticket from the system upon the dashboard. Under Pay & Go, the subscriber may buy a membership or subscription to the invention or pay by the hour at a specific parking space. Pay & Go operates to accommodate the motorists who do not own a cell phone or smart phone, or who forget their phone. The subscriber may pay for the membership through a credit card, a debit card, or cash using a Pay & Go ticket vending machine. The server S knows the parking space locations and cross references the subscriber's location, through a GPS fix upon the subscriber's device as at 46, to the parking space for display to the parking control officer as later described in FIG. 4. The server S provides to the officer whether a subscriber occupies a space or that PAID for time remain for a parking space occupied by a non-member paying by the hour. The present invention collects the pay codes and displays select meters or spaces in PAID status when a subscriber vehicle parks adjacent to a meter. The present invention identifies the make, model, and color of a subscriber and provides a typical vehicle image upon the portable electronic device of the parking control officer. In an alternate embodiment, the subscribing motorist receives a code for emission from a portable electronic device indicating parking is paid or from a device that emits a paid code.

Having reached this part of the present invention, the parking control officer then glances at the visual image on the portable electronic device to identify unpaid parking spaces and then glances at the actual scene to find vehicles in the unpaid parking spaces. The parking control officer then proceeds with enforcement measures against the vehicles in unpaid spaces, such as writing parking tickets or deploying a boot. The parking control officer can perform these glances while on foot or in a vehicle when on patrol.

When displaying the visual scene as at 20, the present invention utilizes additional steps to compose the scene on the portable electronic device for the parking control officer. The scene display begins with acquisition of a visual street image as at 21, particularly during inclement weather such as fog. The invention acquires the street image from a third party provider such as StreetView™ from Google®. The provider has generally captured the visual street image in the past. The invention selects the visual street image knowing the position and direction of the portable electronic device held by the parking control officer. Recognizing the selected image is dated from the actual scene by the parking control officer, the invention overlays visual representations of cars and trucks upon the visual street image as at 22. The representations correspond to cars and trucks where the motorist has subscribed to a previously mentioned parking plan as previously shown at 41. The present invention includes a library of car and truck images indexed by make, model, and color. When the present invention detects a car or truck of a subscriber, the invention selects the appropriate representation and places it upon the street image.

At this step of displaying a visual scene, 20, the present invention also accounts for darkness, rain, and other bad weather. During darkness, a parking control officer may have difficulty determining the color, make, and model of a subscriber's vehicle. The present invention, upon detecting darkness, adjusts the representation of the subscriber vehicles to show the license plate numbers and letters of the vehicles, as at 23. During rain and other weather that reduces visibility, such as fog and snow, the present invention calls up an image from Google® Street View™ and provides that image upon the display with the overlain parking status. In an alternate embodiment for fog usage, the present invention displays a visual outline of a subscriber's vehicle along with its license plate numbers and letters. The present invention detects these situations utilizing existing applications that provide real time weather at a position and the amount of sunlight at a position. The present invention also includes an override feature where the parking control officer U, as at 50, can adjust, as at 23, the display upon command to a night or bad weather setting as previously described. Also for night usage, the present invention utilizes a night view of the street scene 21 as provided by Google® street view. In an alternate embodiment, the present invention allows for usage of a collection of stored night vision images of key locations related to a parking area.

However, the present invention still operates in the absence of GPS. Without GPS, the portable electronic device of the officer still includes an onboard map library and the officer then clicks upon his position using dead reckoning. The portable electronic device, such as a tablet computer, then communicates the map location to the server and retrieves from the server then parking status for nearby parking spaces and displays them upon the image stored in the tablet computer.

The step of merging meter information, as at 30, or parking space information, also includes various substeps. The parking space information begins with identifying the position of a parking space, as at 31, utilizing a sensor 32. Select sensors have smart capability and emit their status, condition, and position using radio frequency similar to smart phones. Existing meters though lack transmitting capability and do not provide their position directly to the invention. For existing meters, the present invention utilizes the position of the parking control officer and identifies the positions of parking spaces or meters upon the street image acquired previously, as at 21. In an alternate embodiment, the present invention consults a table of GPS fixes for parking meters or spaces and overlays those parking spaces appearing within the street image displayed to the parking control officer. In an alternate embodiment, each parking space, or location, has painted stripes upon the ground and a painted identification number. The identification number can be located on the road surface, adjacent curb, or the sidewalk adjacent to the parking space. The parking space identification number corresponds to a database upon a parking authority's server. Other parking spaces remain under the control of a "Pay & Go" device. Such devices, often at lots, allow a motorist to pay for parking at a central, automated device, to receive a ticket, and then to proceed on his way without returning to the motorist's vehicle to leave the ticket upon the dashboard as in the prior art. In an alternate embodiment, the parking authority server has communication with each "Pay & Go" device so that a motorist may pay for parking utilizing the "Pay & Go" device, or a cell phone or a smart phone through an account of the present invention. The present invention then communicates payment status to the parking authority server which then instructs the "Pay & Go" device to print a ticket with the parking location, end time for parking and start time for parking.

With a parking meter or parking space position identified, the present invention then determines if a car or truck occupies a parking space regulated by that sensor as at 32. During this substep, the present invention displays a visual representation of a subscriber's car or truck if that vehicle is detected proximate that parking space. The present invention uses augmented reality technology, or AR technology, to overlay the status of a parking location upon a live visual image of the street proximate the parking control officer. The AR technology places the parking status upon the image so that the officer sees both simultaneously and can then act appropriately. Upon deploying the invention to a tablet computer, the AR technology provides the parking status over a camera view provided by the tablet in either two dimensions, 2D, or in three dimensions, 3D.

In an alternate embodiment, in the absence of a subscriber's vehicle, the present invention utilizes augmented reality technology, or AR technology, to determine if a vehicle occupies a parking space in the actual street scene. The present invention takes the actual visual street scene and removes the third party provider's visual street image leaving a residual image of a vehicle present or absent from a parking space. If the present invention detects a vacant parking space, the invention does not display the status of the parking meter controlling that space.

In an alternate embodiment of this substep—parking space occupation, a sensor 32*a* embedded in the street surface of a parking space detects the presence or absence of a vehicle over it. More particularly, the sensor attains an active state when a vehicle has a position over the sensor and remains inactive without a vehicle over it. In the active state, the sensor signals a server that a vehicle occupies a parking space. In the inactive state, the sensor goes dormant and the server notes the absence of a signal from the sensor thus indicating an available parking space. The lack of signal in the inactive state also conserves power in the sensor thus lengthening its useful life. A prolonged lack of signal when a parking space is known as occupied through other means indicates a sensor failure that the system operator must repair. This embodiment provides information to the server about parking space occupation independent of payment status. This embodiment notifies the server about a parking space that becomes available before its paid time has run out. This occurs when a motorist departs a parking space before the reserved time expires and does not inform the server of the early departure. Motorists perform this behavior when a meeting or other event ends earlier than expected. Motorists often do not want the bother of reclaiming the funds for the remaining time at a parking space when they leave early. This embodiment allows the system 1 to direct other motorists to newly unoccupied parking spaces, though paid for time remains on a parking space. The alternate embodiment of the parking space occupation has usefulness at times of high demand for parking spaces. This alternate embodiment has at least one sensor, 32, installed in each parking location or space, that detects the presence or absence of a vehicle over the sensor. The sensor then communicates the presence or absence of a vehicle to the server S where the server then recognizes whether a motorist has his vehicle present in the space with payment, his vehicle present in the space without payment, or no vehicle in the space with payment remaining. The server, acting upon information from the sensor, then adjusts the parking status displayed to the officer to show an approved vehicle, green symbol, an unapproved vehicle subject to enforcement, red symbol, or an available parking space, no symbol. The server also displays available parking spaces to subscribers presently near an available parking space or whose destination is near an available parking space.

When a subscriber's vehicle or another vehicle occupies a parking space, the present invention determines and displays the payment or other status of a parking meter or space as at 33. For a subscriber's vehicle, the present invention generally identifies the parking space with a flag 47, generally a "PAID" graphic or green flag upon the portable electronic device, unless the subscription has run out for the vehicle. The green flag or PAID graphic instructs the parking control officer to pass the vehicle and not issue a ticket. For expired subscription vehicles, the portable electronic device provides an "UNPAID" graphic or red flag upon the portable electronic device. But for the red flag or UNPAID graphic, the invention instructs the parking control officer to stop at the vehicle and issue a ticket. For non-subscriber vehicles, the present invention relies upon the parking sensors 32, or select meters. The sensors 32 emit their status by radio frequency similar to a cell phone. The present invention then collects the payment status of a sensor and displays that as a paid graphic or flag, or an unpaid graphic or flag upon the portable electronic device. For other meters, the present invention relies upon the parking control officer to determine the parking meter payment status by inspection of the meter. The parking control officer then takes appropriate enforcement action as necessary.

In other situations, parking locations or spaces may not have a PAID or UNPAID status. Such situations include damage to a sensor or a meter, repair of a sensor or meter, disabling of the sensor or meter for nearby construction, and police order such as for parades. Similar to payment status, the present invention visually displays other status of server instructions provided on a display unit, typically at a Pay & Go unit or upon the portable electronic device of the parking control officer. For other meters, the present invention overlays disabled servers or meters on the portable electronic device when the server of the parking authority provides that status to the operator of the present invention. Otherwise, the present invention relies upon the observation and inspection of the parking control officer to identify disabled meters and vehicles parked where a temporary situation prohibits such parking.

Figure 4:
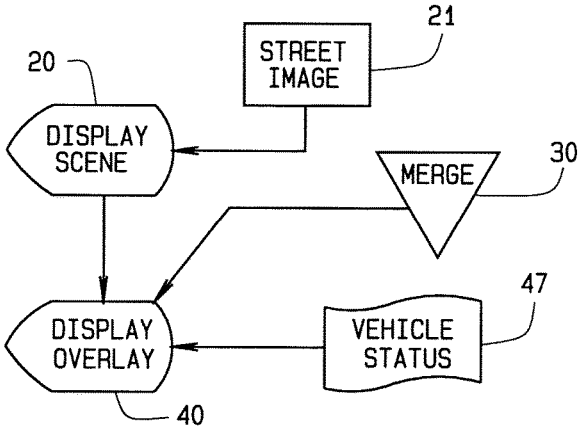
FIG. 4 provides a flow chart of the display parking status step of the present invention.

Turning to FIG. 4, the present invention visually displays vehicles and their parking status upon a street image, as at 40. This informed display merges information from previous steps and substeps of this invention. The informed display 40 includes the visual scene 20 from the third party provider image 21 overlaid with visual representations of vehicles 22, the visual status of parking spaces or meters positioned within the visual scene as from step 30, and the payment status of a vehicle in a parking space as at 47. The display of the visual scene combines the roadway or lot with adjacent buildings, vehicles, parking spaces, parking meters, and meter status upon one screen of a portable electronic device for a parking control officer to observe and take appropriate enforcement action. The display of flags 47 adjacent to vehicles simplifies the job of the parking control officer when making his rounds of a beat of parking spaces.

Figure 5:
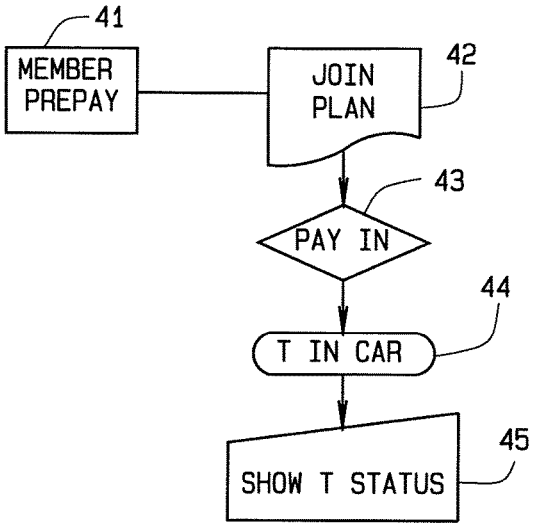
FIG. 5 illustrates a flow chart of the membership embodiment of the invention.

Previously, the present invention includes a visual overlay of a subscriber's prepayment status, as at 41, upon an image of a street, as at 40. FIG. 5 describes how a motorist's car or truck identifies the motorist as a subscriber to passing parking control officer. The present invention establishes a parking plan for subscribers as an electronic application with the backing of at least one financial institution as at 42. The plan collects the subscriber's name, mailing address, email address, telephone number, preferred payment method, and select parking preferences. The plan then establishes an account for the motorist as a subscriber to the plan, and alternatively notifies a parking authority server of the subscriber's membership. Based upon the preferred payment method, the present invention accepts prepayment for parking in various amounts into the subscriber's account, as at 43. Alternatively, the present invention bills a credit card, processes an ACH transfer, electronically withdraws funds from an account identified by the subscriber, or electronically debits a cell phone or smart phone account with a phone provider.

In an alternate embodiment, the present invention issues a transponder to each subscriber, as at 44. Alternatively, the transponder includes a radio frequency identification chip, or RFID chip. The transponder communicates with any adjacent sensor or smart meter when a subscriber parks a car or truck at such a parking location. When parking at existing meters, the subscriber selects the duration of time desired for parking upon the transponder, pays for the parking by debiting the subscriber's account, and leaves the transponder in the car or truck while parked. Then any passing parking control officer can have his portable electronic device visually display the parking status of subscribers through their transponders, as at 45. Alternatively, the portable electronic device of a subscriber includes a software application that allows the subscriber to pay for parking against the subscriber's account and that allows the portable electronic device of the subscriber to serve as a transponder, emitting PAID meter status to any passing parking control officer. In a further alternate embodiment, a subscriber's portable electronic device using the present invention can identify the nearest unoccupied parking space to the subscriber and to the subscriber's destination, and also provide a warning to the subscriber when payment for a parking space will run out.

Figure 6:
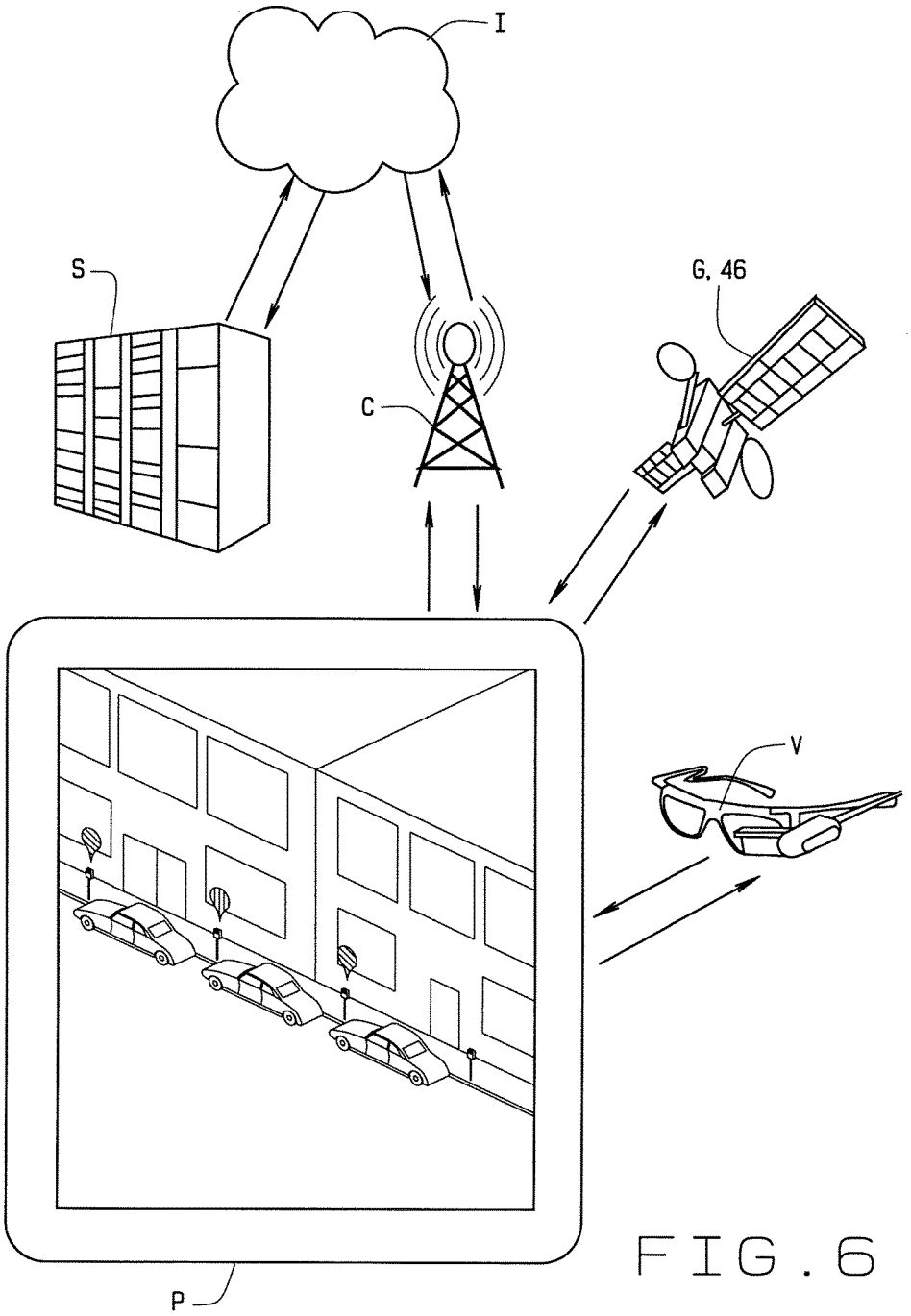
FIG. 6 shows a pictorial representation of communication channels and devices used by the present invention; and, FIG. 7 describes an alternate embodiment of the invention deployed within a vehicle.

FIG. 6 shows a schematic of various communication components utilized by the present invention. The present invention generally operates upon a portable electronic device of a parking control officer as at P, preferably a tablet computer. The portable electronic device may be one of various models presently on the market from third party suppliers. Generally a parking authority selects the portable electronic device so long as it can communicate, as at C, via the internet I to the parking authority servers S. Such portable electronic devices include smart phones, tablets, Palm® devices, Apple® iPad and iPhone devices, select Blackberry® devices, and the like. The portable electronic devices also include virtual video glasses that a parking control officer wears, or parking status glasses. The virtual video glasses provide a heads up display of parking status and other information to the officer. Often the virtual video glasses partially or fully wrap around the head of an officer. Other virtual video glasses have a frame that locates a screen in front of one eye of the officer. The screen provides parking status and other information while the brain of the officer combines the screen display with the scene from the other eye into a combined visual image.

Figure 7:
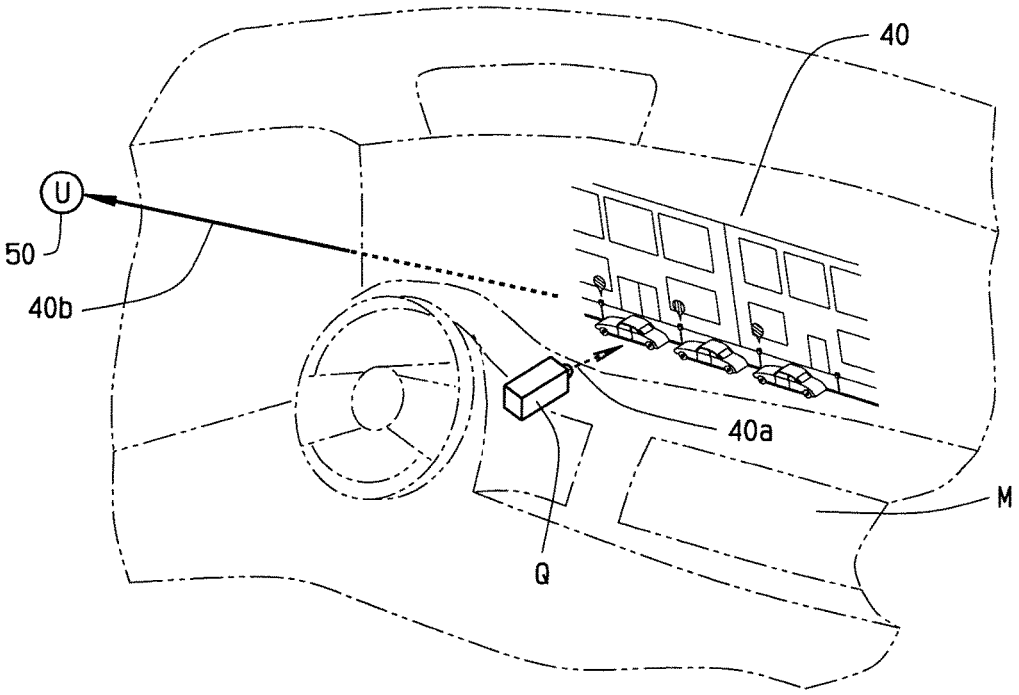

In a further alternate embodiment shown in FIG. 7, the present invention provides a heads up display utilizing a pico-projector Q mounted upon the dashboard or other console of the parking control officer's vehicle M, such as a motorcycle. The projector transmits an image, as at 40*a*, of the parking status of vehicles in the field of view of the officer. The image reflects upon the interior surface of the vehicle windshield as at 40*b* and then the officer U sees the image of parking status overlaid upon his natural view of parked cars, as at 50. To the officer, the image appears ahead of the officer's vehicle at a predetermined distance, approximately 8 to 10 feet. The projector receives its image signal from the portable electronic device P of the officer where the signal contains the status of vehicles proximate the location of the officer's portable electronic device from the server S and the direction of movement as calculated by the officer's portable electronic device P. This alternate embodiment conveys parking status to a parking control officer who may be wearing prescription glasses or other eyewear that prevent wearing of virtual video glasses. In the preferred and alternate embodiments, these preceding heads up display devices may come in various forms and generally allow a parking control officer to use a head mounted display freeing up the hands of the officer for driving and other tasks.

The portable electronic device of a parking control officer ascertains its position utilizing fixes from the GPS system, as at G, and its orientation from an onboard gyroscope and compass. The portable electronic device then communicates its position via the cellular telephone network, as at C, or other wireless telecommunications network and then over the internet, as at I, to at least one server, as at S. In its operation, the present invention utilizes at least one of the following networks for communication and position fixing, wireless internet through wireless fidelity or WiFi, the global positioning system satellite signals, and cellular telephone networks including general packet radio service "GPRS", global system for mobile "GSM", frequency division multiple access "FDMA", code division multiple access "CDMA", and satellite telephone.

The server accesses the images of the street, as at 20, based upon the position of the portable electronic device, as at 10, and merges parking meter status, as at 30, upon the image of street for visual comparison by the parking control officer with the actual street scene. The server downloads an image of the street augmented with subscriber vehicle positions, subscriber meter status, non-subscriber vehicles, and existing meter status. The server also stores and operates the database of the subscribers to the invention and communicates to the various portable electronic devices of the parking control officers and receives information from the subscribers' portable electronic devices often upon the same communications networks as described above. In an alternate embodiment, the server supports interactive voice response, "IVR", multimedia messaging service, "MMS", and credit card processing. In an alternate embodiment, the server delivers parking space status information through audio, such as WAV files, to a parking control officer. The delivered information informs an officer about the parking spaces occupied by vehicles where the payment for the space has run out. For example, the server streams a voice reciting "parking without payment for the red Corvette in parking space 56789 at 123 Main St." to a speaker in the portable electronic device of the officer so that the officer hears the information while moving on patrol and viewing his beat.

The present invention also foresees a parking control officer equipped with Bluetooth® equipment for hands free verbal communication through his portable electronic device, a printer capable of Bluetooth® connectivity to the portable electronic device of the officer, a dedicated parking ticket printer, and an RFID reader. An RFID reader serves an officer well in garages and large parking lots where visual street scenes often appear the same. The RFID reader then detects any RFID chips proximate a parking space, a subscriber's vehicle, a subscriber's portable electronic device, and like locations.

The present invention represents the parking status of one or many parking spaces, up to a plurality, upon a screen of a user's portable electronic device. The statuses appear upon a real time camera view, any of parking space utilizing this invention and show as PAID for current payment and UNPAID upon exhaustion of payment. A subscriber, such as a motorist, utilize the present invention to reserve at least one parking space and then to pay for it. The present invention has various components that cooperate and transform upon a computer, whether stand alone PC or a remote server, the location data of parking spaces and payment status data of the parking spaces cross reference with subscriber paid data into indicia or sounds of UNPAID parking placed upon the real time camera view on the screen of a user's device for enforcement.

The present invention begins with assembling a database upon a computer of parking spaces to be covered by the invention. The database includes the geographic locations of the parking spaces and their respective time limits, such as hours of operation and duration of allowed parking. The invention then creates and updates a database upon a computer of subscribers, such as motorists. The subscriber database includes a list of parking spaces reserved by each subscriber, a list of parking spaces paid for by each subscriber, and a list of the expiration times for each paid for parking space of each subscriber. The assembly of the databases and their operations occur upon a computer whether standalone as a PC or a server. The subscriber database creating and updating also includes enrolling a subscriber into a membership type plan regarding payment. The enrollment also includes establishing encryption of subscriber financial data and in an alternate embodiment, encryption of all subscriber data.

The invention then calculates a location of a user, typically a parking enforcement officer. The invention adapts and utilizes the location finding feature of the user's portable electronic device. With the known user location, the present invention then determines upon a computer a location of one parking space by comparing the location of the user to the database of the parking spaces and selects one of the parking spaces, typically within three feet of the position of the user, parking enforcement officer. Then knowing the location of a selected parking space, the invention compares upon a computer the location of the selected parking space with the subscriber database and continues the comparison further upon a computer by checking the location of the selected parking space against the list of parking spaces paid for by all of the subscribers for a match between that parking space location and the list of parking spaces paid for by the subscribers.

Upon detecting a match between the location of the selected parking space and the list of parking spaces paid for by a subscriber, the invention then compares the matched parking space to the list of expiration times along with the actual time at the parking space location. Upon detecting the matched parking spaced exceeding an expiration time, the invention displays upon the user's screen an UNPAID payment status upon an image of the matched parking space, wherein the user, parking enforcement officer, may execute enforcement measures upon any vehicle in the matched parking space with a payment status identified as UNPAID.

UNPAID status, and to some extend PAID status, appear on a user's, parking enforcement officer's screen, 6. The UNPAID payment status including various indicia, or a sound, overlaid upon the user's screen or emitted from the user's speaker respectively. The indicia including the word UNPAID, a colored logo, a circle with a bar or a letter X. For a colored logo, the invention has a first color indicating UNPAID status for a short duration such as less than fifteen minutes and a second color indicating UNPAID status for a long duration such as more than fifteen minutes. In a further alternate embodiment, the UNPAID status appears as an audible recitation distributed through the speaker of a user's portable electronic device.

In assembling a database for the parking spaces upon a computer, the invention collects and provides for the location of the center of each of the many parking spaces and a length for each of those spaces. With that location and sizing information, the invention may provide a closer look at a select parking space. The invention compares upon its computer the location of the selected parking space with the database of subscribers and checks locations of parking spaces against the list of parking spaces paid for by the subscribers for two subscribers in adjacent parking spaces. The invention displays an overlay of a shape of one of the parking spaces upon the screen of a user's device, such as upon a real time camera view from a smart phone, for verification of vehicle positions related to that one of the parking spaces. The user can then detect if two vehicles share a space such as an attempt at borrowing or mooching a residual parking fee of one motorist by another. The assembly of the databases and their operations occur upon a computer whether standalone as a PC or a server.

Borrowing a residual fee also occurs in another way. The subscriber database also includes opening an account for each of the subscribers. Each account permits each of subscriber to reserve at least one parking space and then to pay for it utilizing various means of electronic payment: ACH transfer, EFT debit, credit card, wire transfer, cell phone account and the like. Each account also has encryption, at least for financial data if not all data. A residual fee arises when a motorists leaves a parking space before time has expired and a second motorist occupies that parking space. The second motorists borrows, or mooches, a portion of the fee paid by the previous motorist. In high density locations, mooching a parking space also distorts real time inventory of parking spaces. To thwart borrowing or mooching a parking space, the invention, when opening an encrypted account in the subscriber database, allows a subscriber to elect to depart a parking space before the expiration time for the parking space and notes that into the subscriber database. The encrypted account permits a subscriber to request a refund of funds remaining when the subscriber elects to depart a parking space, early, before the expiration time for the parking space. The encrypted account then returns that parking space to inventory of available parking spaces, in the parking space database following the election of the departed subscriber. This feature of the present invention transforms parking space data, payment data, and parking space time expiration data reducing those empty parking spaces before the expiration time and allows other subscribers to utilize those empty spaces.

The present invention also utilizes augmented reality as initially described above. Here when comparing the matched parking space to the list of expiration times and upon detecting the matched parking spaced exceeding an expiration time, the invention utilizing augmented reality upon said user's screen to denote an UNPAID payment status upon an image of a matched parking space. The augmented reality of the invention overlays upon a user's screen showing the length of one parking space centered upon the location of that parking space. In larger deployments of the invention, such as along many blocks or within a garage, the augmented reality of the invention overlays in a linear contiguous relationship upon a user's screen the lengths of many parking spaces and each centered upon the location of each space.

In sum, the present invention transforms upon a computer location data of one or more parking spaces and payment status data of the same parking spaces into indicia, or a sound, of UNPAID parking shown upon the real time camera view on the screen of a user's device, such as a smart phone or tablet computer, for enforcement.

From the aforementioned description, a parking status system has been described. The parking status system is uniquely capable of displaying whether a motorist has paid for parking adjacent to a meter with a flag or other indicator upon an image of the motorist's vehicle shown upon an electronic screen of a parking control officer. The parking status system merges an image of a street and parking space positions with representations of vehicles along with whether each parking space is PAID or UNPAID. The present invention allows motorists to subscribe to a plan where the motorist no long need enter coins into a meter as the motorist completes parking and account transactions via the portable electronic device of the motorist.

The parking status system and its various components may be operated upon at least one computer and may be programmed in various languages, including but not limited to, HTML, Dreamweaver, Visual Basic, C++, Unix, assembly, and the like while various devices referenced by the invention may be manufactured from many materials, including but not limited to, steel, aluminum, polymers, nylon, polyvinyl chloride, high density polyethylene, polypropylene, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A method for representing the parking status of a plurality of parking spaces to a screen of a user's portable electronic device upon a real time camera view, any of said at least one parking space being one of PAID for current payment and UNPAID upon exhaustion of payment, any of a plurality of subscribers utilizing said method to reserve at least one of the plurality of parking spaces and then to pay for at least one of the plurality of parking spaces, the method comprising:

assembling a database upon a computer of said plurality of parking spaces, said database including geographic locations of said plurality of parking spaces and time limits applicable to each of said plurality of parking spaces;

updating a database upon a computer of subscribers, said database including a list of parking spaces reserved by each subscriber, a list of parking spaces paid for by each subscriber, and a list of the expiration times for each paid for parking space of each subscriber;

calculating a location of said user, said calculating a location of said user adapted to utilize a location finding feature of said user's portable electronic device;

determining upon a computer a location of one of said plurality of parking spaces by comparing the location of said user to said database of said plurality of parking spaces and selecting one of said plurality of parking spaces within eight to ten feet of the position of said user;

comparing upon a computer the location of one of said plurality of parking spaces with said database of subscribers further comprising comparing upon a computer the location of one of said plurality of parking spaces against said list of parking spaces paid for by said subscribers for a match between said location and said list of parking spaces paid for by said subscribers;

upon detecting a match between said location and said list of parking spaces paid for by said subscribers, comparing the matched parking spaces to said list of expiration times and upon detecting the matched parking spaces exceeding an expiration time displaying upon said user's screen an UNPAID payment indicia upon an image of the matched parking space, wherein the user may execute enforcement measures upon any vehicle in said matched parking space showing said UNPAID indicia;

wherein said method transforms upon a computer location data of said plurality of parking spaces and payment status data of said plurality of parking spaces into indicia of UNPAID parking spaces;

said comparing the matched parking space to said list of expiration times and upon detecting the matched parking space exceeding an expiration time and said method places said indicia of UNPAID on an image of a matched parking space upon the real time camera view on the screen of a user's device for enforcement.

2. The method for representing the parking status of claim 1 further comprising:

opening an account for each of said subscribers wherein said account permits each of said subscribers to reserve at least one of said plurality of parking spaces and permits each of said subscribers to pay for at least one of said plurality of parking spaces utilizing means of electronic payment.

3. The method for representing the parking status of claim 1 further comprising:

said indicia of UNPAID overlaying upon said user's screen one of the word UNPAID, a colored logo, a circle with a bar, and a letter X.

4. The method for representing the parking status of claim 1 further comprising:

said indicia of UNPAID including an audible recitation.

5. A method for representing the parking status of a plurality of parking spaces to a screen of a user's portable electronic device upon a real time camera view, any of said at least one parking space being one of PAID for current payment and UNPAID upon exhaustion of payment, any of a plurality of subscribers utilizing said method to reserve at least one of the plurality of parking spaces and then to pay for at least one of the plurality of parking spaces, the method comprising:

assembling a database of said plurality of parking spaces, said database including geographic locations of said plurality of parking spaces and time limits applicable to each of said plurality of parking spaces and storing said parking space database upon a computer server;

updating a database of subscribers, said database including a list of parking spaces reserved by each subscriber, a list of parking spaces paid for by each subscriber, a list of the expiration times for each paid for parking space of each subscriber, and storing said subscriber database upon a computer server, and further including enrolling each of said subscribers into a membership plan for parking payment;

calculating a location of said user, said calculating a location of said user adapted to utilize a location finding feature of said user's portable electronic device;

determining upon a computer server a location of one of said plurality of parking spaces by comparing the location of said user to said database of said plurality of parking spaces and selecting one of said plurality of parking spaces within eight to ten feet of the position of said user;

comparing upon a computer server the location of one of said plurality of parking spaces with said database of subscribers further comprising comparing upon a computer the location of one of said plurality of parking spaces against said list of parking spaces paid for by said subscribers for a match between said location and said list of parking spaces paid for by said subscribers wherein upon detecting a match between said location and said list of parking spaces paid for by said subscriber, comparing the matched parking space to said list of expiration times and further upon detecting the matched parking spaces exceeding an expiration time displaying upon said user's screen an UNPAID indicia upon an image of the matched parking space, wherein the user may execute enforcement measures upon any vehicle in said matched parking space showing said UNPAID indicia;

wherein said method transforms upon a computer location data of said plurality of parking spaces and payment status data of said plurality of parking spaces into indicia of UNPAID parking spaces;

said comparing the matched parking space to said list of expiration times and upon detecting the matched parking space exceeding an expiration time and said method places said indicia of UNPAID on an image of a matched parking space upon the real time camera view on the screen of a user's device for enforcement.

6. The method for representing the parking status of claim 5 further comprising:

wherein said indicia of UNPAID includes one of the word UNPAID, a colored logo, a circle with a bar, and a letter X.

7. The method for representing the parking status of claim 5 wherein said indicia of UNPAID includes an audible signal transmitted from a computer server to the user's portable electronic device.

* * * * *